United States Patent [19]

Atkey

[11] 3,948,358

[45] Apr. 6, 1976

[54] ELEVATOR RAIL MOUNTING BRACKET

[75] Inventor: Richard E. Atkey, Memphis, Tenn.

[73] Assignee: Dover Corporation, Memphis, Tenn.

[22] Filed: Aug. 16, 1974

[21] Appl. No.: 498,199

[52] U.S. Cl. ..... 187/95; 52/30; 187/1 R

[51] Int. Cl.[2] ..... B66B 7/02

[58] Field of Search ..... 187/95, 1, 2; 52/30, 274, 52/283

[56] References Cited

UNITED STATES PATENTS

| | | | |
|---|---|---|---|
| 3,601,938 | 8/1971 | Loomis | 52/30 |
| 3,741,351 | 6/1973 | Suozzo | 187/95 |

FOREIGN PATENTS OR APPLICATIONS

| | | | |
|---|---|---|---|
| 3,552 | 3/1901 | United Kingdom | 187/95 |

*Primary Examiner*—Evon C. Blunk
*Assistant Examiner*—James L. Rowland
*Attorney, Agent, or Firm*—Brumbaugh, Graves, Donohue & Raymond

[57] ABSTRACT

An elevator rail mounting system for positioning a pair of elevator guide rails, capable of centering an elevator cab therebetween, in a hoistway comprises a U-shaped bracket, mountable in the hoistway an adjustable distance from the entrance side thereof, for fixing the angular relationships of and distances between the guide rails, a landing sill and a hall door frame to insure a constant running clearance between the elevator cab and the landing sill and to maintain the proper alignment of the elevator cab and the hall door frame. The U-shaped bracket includes a horizontally and vertically adjustable cross member mounted from the entrance side of the hoistway substantially adjacent and parallel thereto. A pair of parallel rail brackets, spaced apart by a predetermined distance and extending into the hoistway perpendicularly from the cross member, support the guide rails in a vertical plane substantially parallel to the entrance side of the hoistway and maintain the distance between the guide rails at a predetermined fixed value.

7 Claims, 2 Drawing Figures

ELEVATOR RAIL MOUNTING BRACKET

Figure 1:
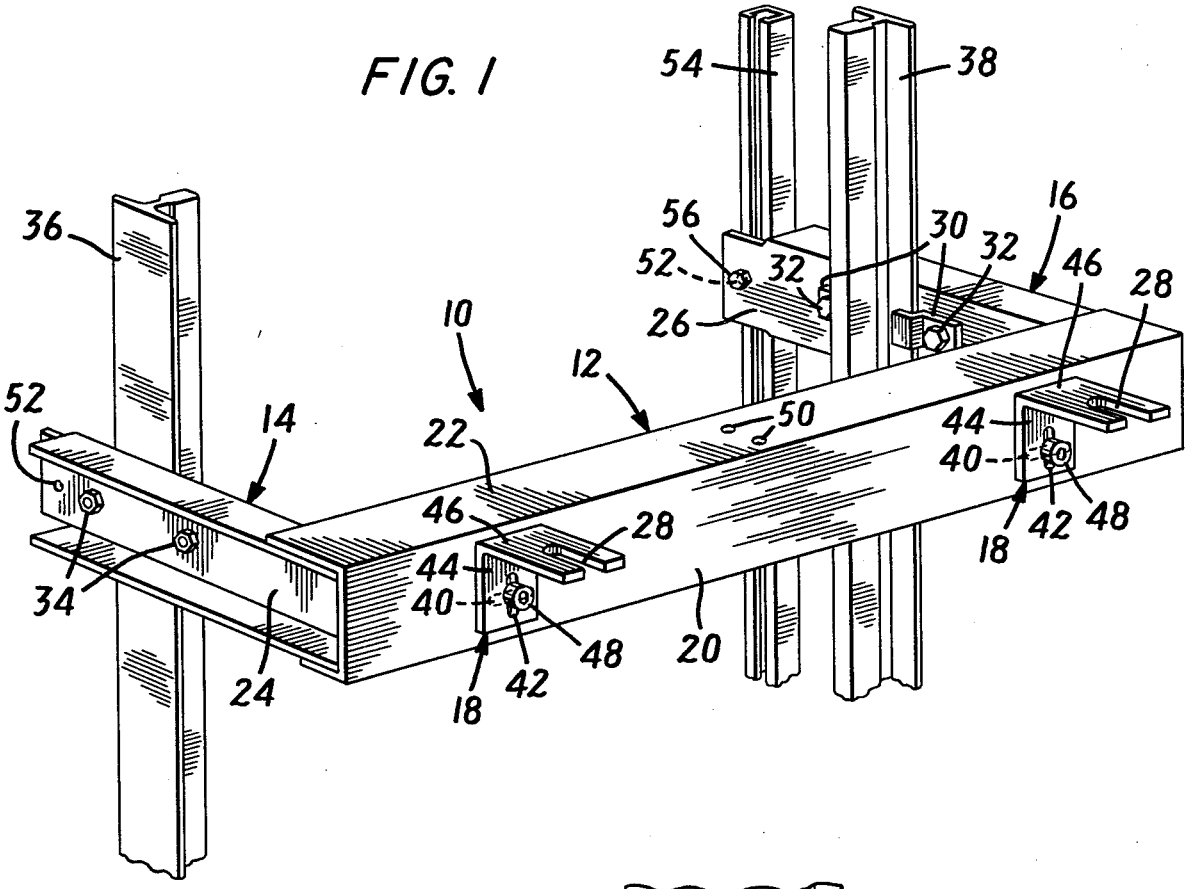

The present invention relates to a rail mounting system for elevator installations, and, more particularly, to a novel and improved rail mounting bracket, mounted from an entrance side of a hoistway, for vertically supporting a pair of guide rails in a parallel relationship and for simultaneously maintaining the proper angular relationships of and distances between the guide rails, a landing sill and a hall door frame.

Conventionally, an elevator is guided along its path of travel in a hoistway by a pair of T-shaped guide rails. For proper operation, the guide rails must be vertical, parallel and maintained in a fixed spaced apart relationship. Furthermore, the guide rails must be positioned correctly in relation to the walls of the hoistway and the machined running surfaces of the guide rails must lie in a single vertical plane.

In practice, guide rails have been conventionally supported by separate brackets, at each floor level. The individual brackets are fastened to the side walls of a hoistway or to concrete or steel beams, which are part of the building structure and run adjacent to the side walls of the hoistway. Since the rail brackets are mounted on both side walls of the hoistway, such arrangements suffer from the disadvantage that there are two supporting walls which must be maintained in a substantially vertical and parallel relationship.

Heretofore, the vertical alignment of the guide rails has been achieved by one of two known methods which are both time consuming and costly. One method utilizes a shim, between the back of the guide rail and a fixed or unadjustable rail bracket, to adjust the position of the guide rail. The other method makes use of an adjustable rail bracket which is doweled or welded after adjustment.

More particularly, a constant running clearance between the elevator cab and the landing sills must be maintained. Also, the elevator cab and the hall door openings, defined by the hall door frames, must be maintained in proper alignment. Thus the landing sills and the hall door frames must be aligned, at each floor, in a given relationship to the guide rails.

In practice, the alignment of the landing sills and the hall door frames has been accomplished by means of a template which contacts both guide rails. Oftentimes, such a method disadvantageously necessitates bracing the hall door frames from the guide rails, at least until supporting walls can be built around the hall door frames.

In accordance with the invention, there is provided a novel and improved rail mounting bracket for elevator installations which normally include an elevator cab, vertically displaceable along a pair of rail guides positioned in a hoistway, and a landing sill and hall door frame positioned along the front or entrance side of the hoistway. The rail mounting bracket of the present invention, which is mounted from the entrance side of the hoistway, includes positioning means attached to a horizontally and vertically adjustable cross member for mounting the bracket in the hoistway an adjustable distance from the entrance side thereof to properly position the rail guides in the hoistway.

Mounting means are also provided on the cross member for fixedly supporting the landing sill and hall door frame in relation to the guide rails. Accordingly, the rail mounting bracket advantageously fixes the angular relationships of and the distances between the guide rails, the landing sills and the hall door frames to insure a constant running clearance between the elevator cab and the landing sill and to maintain the proper alignment of the elevator cab and the hall door frame.

A pair of parallel rail brackets, spaced apart by a predetermined distance and extending into the hoistway perpendicularly from the cross member, support the guide rails in a vertical plane substantially perpendicular to the entrance side of the hoistway and maintain the guide rails in a predetermined spaced apart relationship independent of the hoistway side walls.

Since the parallel pair of rail brackets is mounted from the cross member and the cross member is mounted from the entrance side of the hoistway, only a single supporting wall is utilized. Accordingly, since there is only one supporting wall, there is no need to maintain the side walls of the hoistway in a vertical or parallel relationship, thereby advantageously reducing installation time and costs. More pertinently, since the rail mounting bracket is mounted from the entrance side of the hoistway no scaffolding is necessary for the installation of the bracket.

Additionally, the rail mounting bracket may also be provided with means for mounting and aligning electrical conduits or ducts and other hoistway equipment, such as vanes or switches.

Figure 2:
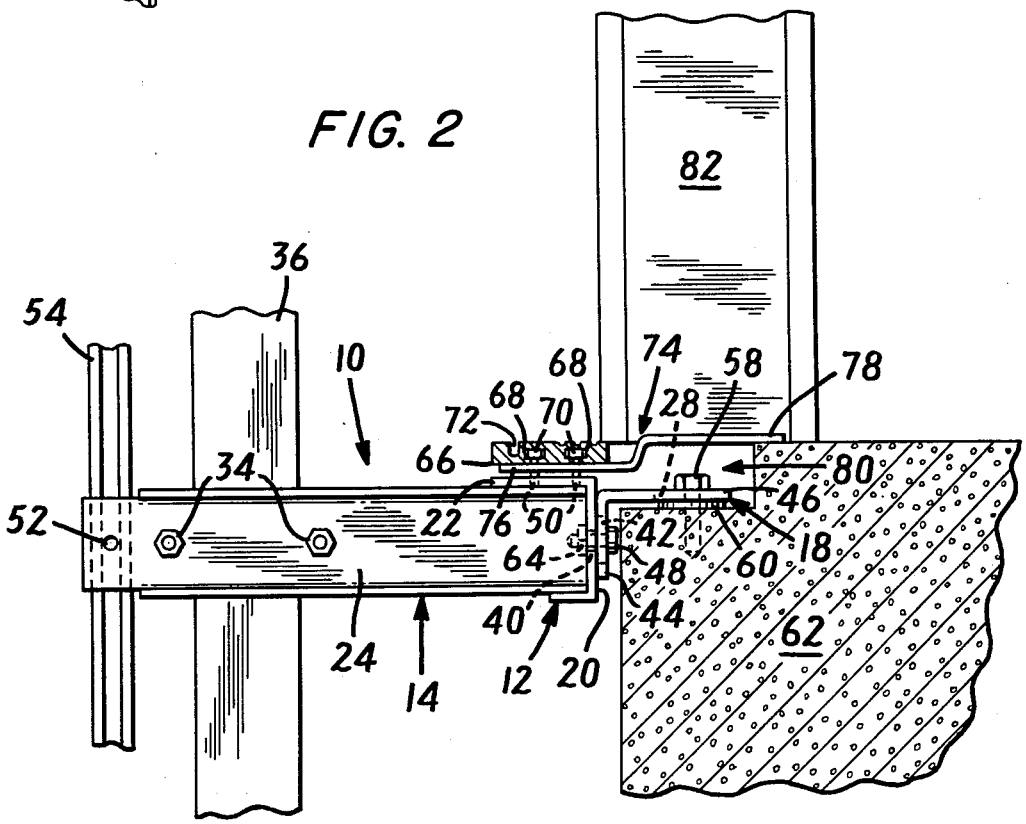

For a more complete understanding of the invention, reference may be had to the following detailed description taken in conjunction with the accompanying figures of the drawing, in which:

FIG. 1 is a perspective view of an exemplary embodiment of the rail mounting bracket of the present invention; and FIG. 2 is a side elevational view of the rail mounting bracket of FIG. 1 positioned in an elevator hoistway, in accordance with the invention.

In FIG. 1, a rail mounting bracket 10 of the invention is adjustably mounted in a hoistway (not shown). The U-shaped rail mounting bracket 10 comprises a C-shaped cross member 12 and a pair of parallel C-shaped rail brackets 14, 16 spaced apart by a predetermined distance and extending into the hoistway perpendicularly from the cross member 12.

The rail brackets 14, 16 support guide rails 36, 38, respectively, in a vertical plane substantially parallel to the cross member 12 and maintain the distance between the guide rails 36, 38 at a predetermined fixed value. The guide rail 38 is releasably mounted to the rail bracket 16 by a pair of rail clips 30, 30 which are secured to a vertical side wall 26 of the rail bracket 16 by a pair of bolts 32, 32 and an associated pair of nuts (not shown). Similarly, the guide rail 36 is attached to the rail bracket 14 by a pair of rail clips (not shown) which are secured to a vertical side wall 24 of the rail bracket 14 by a pair of bolts (not shown) and an associated pair of nuts 34, 34.

A pair of angle irons 18, 18 are mounted on a vertical front wall 20 of the cross member 12. Vertical legs 44, 44 of the angle irons 18, 18 are mounted adjacent and parallel to the vertical front wall 20 of the cross member 12 by bolts 48, 48 and associated nuts (see reference numeral 64 in FIG. 2). Vertical adjustment of the angle irons 18, 18 relative to the cross member 12 is provided by vertical slots 42, 42 in the vertical legs 44, 44 of the angle irons 18, 18. Likewise, horizontal adjustment of the angle irons 18, 18 relative to the cross member 12 is provided by horizontal slots 40, 40 in the vertical front wall 20 of the cross member 12. The horizontal legs 46, 46 of the angle irons 18, 18, which are used to mount the rail mounting bracket 10 to a suitable support wall (see FIG. 2), include slots 28, 28 for adjusting the distance between the support wall and the cross member 12 to properly position the rail guides 36, 38 in the hoistway.

A pair of mounting holes 40, 40 in the upper horizontal surface 22 of the cross member 12 are employed for mounting a landing sill and a hall door frame on the cross member 12 as described more fully hereinbelow. It should be understood that any number of mounting holes 40 may be arranged in any suitable manner on the horizontal upper surface 22 of the cross member 12.

A pair of holes 52, 52 may be located in the vertical side walls 24, 26 of the rail brackets 14, 16, respectively. An electrical conduit 54 or other hoistway equipment, such as vanes or switches, is mounted at the end of the rail bracket 16 furthest from the cross member 12 by a screw 56 or other suitable fastening means capable of extending through the hole 52.

In FIG. 2, the rail mounting bracket 10 of the invention is mounted from a floor or sill support beam 62, which defines the entrance side of the hoistway. A conventional sill pocket 80 formed in the support beam 62 receives the horizontal legs 46, 46 of the angle irons 18, 18. Bolts 58 and associated washers 60 rigidly attach the rail mounting bracket 10 to the support beam 62. The distance between the cross member 12 and the sill support beam 62 may be adjusted, as described above, by the slots 28, 28 in the horizontal legs 46, 46 of the angle irons 18, 18. Therefore, the cross member 12 may be mounted substantially adjacent and parallel to the entrance side of the hoistway.

The rail mounting bracket 10 may also support a landing sill 66 and a hall door frame 82, which define a door opening on the entrance side of the hoistway. The landing sill 66, which is conventionally manufactured out of extruded aluminum, is provided along the bottom surface thereof with a pair of T-shaped slots 68, 68. It should be noted that any suitable number of slots 68 may be utilized depending upon the number of mounting holes 50 provided in the upper horizontal surface 22 of the cross member 12. The T-shaped slots 68, 68 run the length of the landing sill 66. Thus bolts 70, 70 may be slid into the T-shaped slots from the end of the landing sill 66.

The bolts 70, 70 are utilized to fasten the landing sill 66 directly to the cross member 12 of the rail mounting bracket 10. Also, the bolts 70, 70 similarly attach a lower end 76 of an S-shaped bracket 74 between the landing sill 66 and the cross member 12 of the rail mounting bracket 10. Since the hall door frame 82 is attached to an upper end 78 of the S-shaped bracket 74, the rail mounting bracket 10 also supports the hall door frame 82. Therefore, the rail mounting bracket 10 advantageously fixes the relationships of and the distances between the guide rails 36, 38, the landing sill 66 and the hall door frame 82 to ensure a constant running clearance between the elevator cab and the landing sill 66 and to maintain the proper alignment of the elevator cab and the hall door frame 82.

It should be noted that the landing sill 66 is provided with a groove 72 in the upper surface thereof for slidably receiving a door gib which guides the lower portion of the elevator door during the opening and closing thereof.

Thus there is provided, in accordance with the invention, a novel and improved elevator rail mounting system wherein a U-shaped bracket functions as a combined template for mounting and fixing the positional relationships of a pair of guide rails, a landing sill and a hall door frame; and rail bracket for supporting and properly positioning the guide rails with respect to one another.

It will be understood by those skilled in the elevator art that the above described embodiment is meant to be merely exemplary and that it is susceptible of modification and variation without departing from the spirit and scope of the invention. Therefore, the invention is not deemed to be limited except as defined in the appended claims.

I claim:

1. An elevator rail mounting system for positioning a pair of elevator guide rails, capable of centering an elevator therebetween, in a hoistway, having a pair of side walls and an entrance side defined by a landing sill and a hall door frame, comprising a U-shaped bracket capable of being mounted in the hoistway from the entrance side thereof, said U-shaped bracket including a cross member mounted from the entrance side of the hoistway and substantially adjacent and parallel thereto, said cross member having mounting means for fixedly supporting the landing sill and hall door frame in relation to the guide rails, whereby the angular relationships of and distances between the guide rails, the landing sill and the hall door frame are fixed to insure a constant running clearance between the elevator and the landing sill and to maintain the proper alignment of the elevator and the hall door frame, a pair of parallel rail brackets, spaced apart by a predetermined distance and extending into the hoistway perpendicularly from said cross member, for supporting the guide rails in a vertical plane substantially parallel to the entrance side of the hoistway and maintaining the distance between the guide rails at a predetermined fixed value independent of the side walls of the hoistway, whereby only a single supporting wall for the guide rails is utilized.

2. An elevator rail mounting system according to claim 1, further comprising positioning means for mounting said cross member an adjustable distance from the entrance side of the hoistway to properly position the guide rails in the hoistway and for permitting the horizontal and vertical adjustment of said cross member in relation to the hoistway.

3. An elevator rail mounting system according to claim 2, wherein said positioning means includes a pair of angle irons, each of said angle irons having a first leg mountable parallel and adjacent to said cross member and a second leg perpendicular to said first leg and extending outward away from said cross member, said first leg having a vertical slot therethrough and said second leg having a longitudinal slot therethrough; a pair of horizontal slots in the surface of said cross member adjacent said first leg of said angle irons; first fastening means capable of simultaneously extending through said vertical slots in said first legs of said angle irons and said horizontal slots in said cross member, when said vertical and horizontal slots are aligned, for horizontally and vertically, adjustably mounting said angle irons to said cross members and second fastening means capable of extending through said longitudinal slots in said second legs of said angle irons into the entrance side of the hoistway for mounting said cross member an adjustable distance from the entrance side of the hoistway.

4. An elevator rail mounting system according to claim 1, further comprising additional mounting means on said rail brackets for mounting and aligning electrical conduits in relation to the guide rails.

5. An elevator rail mounting system according to claim 1, wherein said rail brackets are the sole supporting means for the guide rails.

6. An elevator rail mounting system according to claim 1, wherein the guide rails are releasably supported by said rail brackets.

7. An elevator rail mounting system according to claim 1, wherein said rail brackets extend into the hoistway below said mounting means for the landing sill and hall door frame.

* * * * *